US006513298B2

(12) United States Patent
Rassel

(10) Patent No.: US 6,513,298 B2
(45) Date of Patent: Feb. 4, 2003

(54) WEB CONNECTOR

(75) Inventor: Douglas A. Rassel, Griffith, IN (US)

(73) Assignee: Aegis Metal Framing LLC, Chesterfield, MO (US)

( * ) Notice: Subject to any disclaimer, the term of this patent is extended or adjusted under 35 U.S.C. 154(b) by 0 days.

(21) Appl. No.: 09/754,751

(22) Filed: Jan. 4, 2001

(65) Prior Publication Data

US 2002/0083674 A1 Jul. 4, 2002

(51) Int. Cl.[7] ..... E04B 1/18

(52) U.S. Cl. ..... 52/633; 52/738; 52/36.5; 52/287.1

(58) Field of Search ..... 52/693, 695, 712, 52/731.7, 731.8, 633; 403/187, 188, 217, 167, 169, 230

(56) References Cited

U.S. PATENT DOCUMENTS

| | | | | |
|---|---|---|---|---|
| 4,817,359 A | | 4/1989 | Colonias | |
| 4,881,355 A | * | 11/1989 | Bosl et al. | 52/738 |
| 4,890,436 A | | 1/1990 | Colonias | |
| 4,897,979 A | | 2/1990 | Colonias | |
| 4,964,253 A | | 10/1990 | Loeffler | |
| 5,042,217 A | | 8/1991 | Bugbee et al. | |
| 5,253,465 A | | 10/1993 | Gilb | |
| 5,791,093 A | * | 8/1998 | Diamond | 52/36.5 |
| 5,857,306 A | | 1/1999 | Pellock | |
| 6,076,325 A | | 6/2000 | Sluiter | |
| 6,341,458 B1 | * | 1/2002 | Burt | 52/287.1 |

FOREIGN PATENT DOCUMENTS

| | | |
|---|---|---|
| EP | 0 637 656 A3 | 2/1995 |
| EP | 0 637 656 A2 | 2/1995 |
| GB | 2 147 025 A | 5/1985 |

OTHER PUBLICATIONS

Brochure entitled Hook & Hang Metal Truss Connection, published by Progressive Panel Systems Inc, Zeeland, Michigan, published at least as early as Dec. 2000.

* cited by examiner

*Primary Examiner*—Carl D. Friedman
*Assistant Examiner*—Steve Varner
(74) *Attorney, Agent, or Firm*—Kirkpatrick & Lockhart LLP

(57) ABSTRACT

A web connector, a building component connection and a method for connecting a first building component to a second building component. One embodiment of the web connector includes a rib member that is attachable to a web portion of the first building component and an attachment plate extending outward from the rib member. The rib member may be sized so that it is received on a leg portion that protrudes from the web portion of the first building component. The attachment plate is attachable to an attachment flange of the second building component. In another embodiment, the web connector includes two rib members and an attachment member that forms two plates for attaching two additional building components thereto.

35 Claims, 6 Drawing Sheets

WEB CONNECTOR

CROSS-REFERENCE TO RELATED APPLICATIONS

Not applicable.

FEDERALLY SPONSORED RESEARCH

Not applicable.

BACKGROUND OF THE INVENTION

1. Field of the Invention

The invention relates to building components, and more particularly to a web connector for connecting two or more building components.

2. Description of the Invention Background

Many prior art connectors are available for joining supported wooden trusses at an angle with a main supporting truss and are used, for example, in the construction of roofs for buildings. Metal connectors such as those disclosed in U.S. Pat. No. 5,253,465, U.S. Pat. No. 5,042,217, and U.S. Pat. No. 4,964,253 were designed for wood frame trusses, which typically comprise bulky members with rectangular cross-sections. Each of the connectors disclosed in these patents includes a seat to receive the bottom chord of a wood member. The supported wood members, such as corner (or hip) trusses and jack trusses that form the connection with the main supporting wood girder, are typically fastened at their sides with appropriate sidewalls or flanges of the metal connector. These connections are cumbersome to assemble and require that the supported trusses be stabilized and supported by some other means while they are fastened to the metal connector.

Roof trusses have also been fabricated from metal materials. The building construction industry has found that metal trusses can be lighter in weight than comparable wooden trusses and metal offers superior fire retardant characteristics. Such metal trusses must also be supported and stabilized during their interconnection to other portions of the building.

There remains, therefore, a need for an improved connector that can be used to connect building components, such as trusses or joists and that overcomes limitations, shortcomings and disadvantages of prior art connectors.

SUMMARY OF THE INVENTION

The present invention meets the identified needs, as will be more fully understood following a review of this specification and drawings.

One embodiment of the invention includes a web connector that has a rib member and an attachment plate. The rib member is constructed for attachment to the web of a first building component and may be sized so that is supported on a leg that protrudes outwardly from the first building component. In addition, if the first building component has a lip that protrudes upwardly from the leg, a notch sized to receive a portion of the lip therein may be provided in a portion of the rib directly adjacent to where the attachment plate joins the rib member. The notch allows the web connector to sit tightly into the leg of the first building component. The attachment plate may be oriented at a predetermined angle relative to the rib and is constructed for attachment to a second building component.

Another embodiment of the invention includes first and second rib members and an attachment member that is attached to or adjoins the first and second rib members and extends therebetween. In one embodiment, a notch may be provided in each rib member for receiving a corresponding portion of a lip formed on the leg of the first building component. The notch provides a partial bearing condition for the web connector from the first building component. The attachment member may form two adjoining component plates oriented at an angle relative to each other.

In yet another embodiment of the invention, the web connector may be configured such that the height of the rib member is substantially equal to the height of the web portion of the first building component so that it functions both as a web member of the first building component and as a connector to accept a second building component.

Another embodiment of the invention includes a method of attaching a first building component to a second building component, where the first building component includes a web portion and a leg portion that extends generally outwardly from the web portion. This embodiment also includes providing a web connector that has a rib member and an attachment plate that extends outward at an angle from the rib member. The rib member also has a web attachment element. The method further includes supporting the rib member on the leg portion of the first building component and fastening the web attachment element of the rib member to the web portion of the first building component. The attachment flange of the second building component is fastened to the attachment plate of the web connector.

It is a feature of at least one embodiment of the invention to provide a connector for interconnecting a variety of different building components that is easy to install and economical to manufacture.

Another feature of at least one embodiment of the invention is to provide a connector for interconnecting building components that provides rigidity and support to the building components.

Accordingly, various embodiments of the invention provide solutions to the shortcomings of other building component connectors and methods. Those of ordinary skill in the art will readily appreciate, however, that these and other details, features and advantages will become further apparent as the following detailed description proceeds.

BRIEF DESCRIPTION OF THE DRAWINGS

FIG. 2(*b*) is schematic side view showing the profile of a corner truss;

FIG. 4(*b*) is a plan view showing the connection of the supporting girder truss to the two supported corner trusses;

FIG. 5(*b*) is a schematic drawing of a notch formed in the web connector for positioning adjacent the upward lip of the bottom chord of the girder truss;

DETAILED DESCRIPTION OF THE INVENTION

Figure 1:
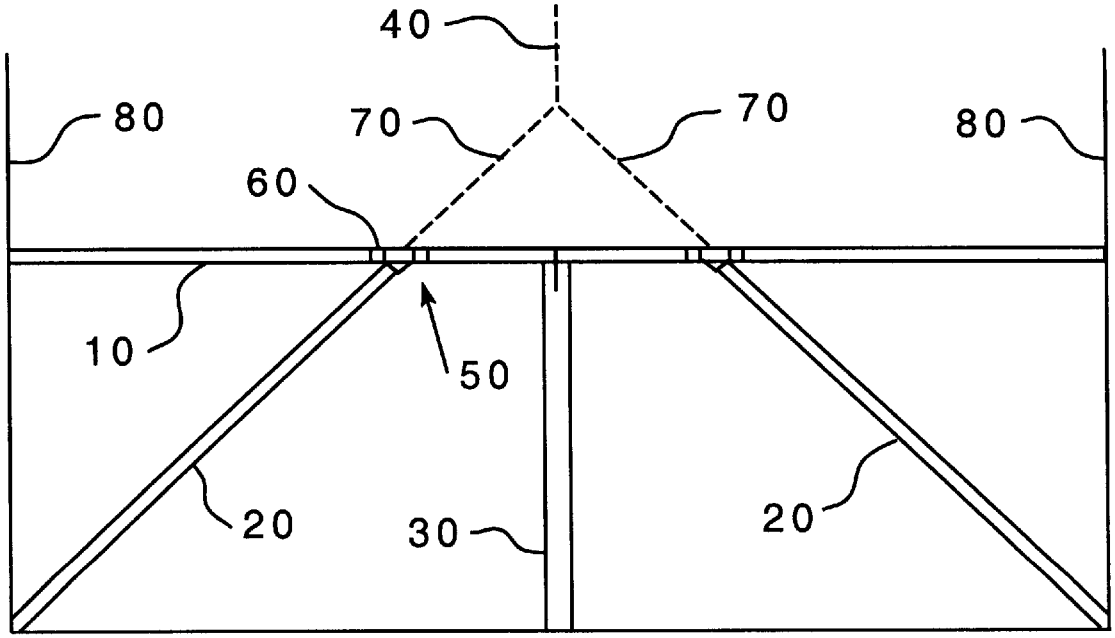
FIG. 1 is a schematic partial plan view of the hip set layout of a roof incorporating an embodiment of a web connector of the invention.

Referring now to the drawings for the purpose of illustrating the invention and not for the purpose of limiting the same, there is shown a web connector 60 of the invention for connecting building components, such as, for example, beams, joists, girders, etc. The reader will appreciate that the building components may also comprise components of supporting or supported trusses, such as girder trusses, corner or jack or hip trusses, used, for example, in roof systems. The web connector may be used to attach a first building component to a second building component. Generally, the first building component may be any building component having a web portion and a leg portion extending outwardly from the web portion. The leg portion may also have a lip extending generally upwardly from the leg portion. A first building component may include, for example, the bottom chord of a girder truss or other supporting truss, or any beam or joist that has a generally C-shaped cross-section, as will be described in more detail herein. The second building component may be any building component having an attachment flange, and may include the vertical member of a corner truss or other supported truss, or any beam or column or joist having a flange. In addition, it will be appreciated that the characterizations of various components described herein as extending, for example, upwardly or downwardly, or being vertical or horizontal, are relative characterizations only based upon the particular position or orientation of a given component for a particular application. In typical roof applications, the first building component may be a girder truss having a horizontal bottom chord with a vertical web, and the second building component may be a corner truss having a vertical member with a vertical flange.

FIG. 1 is a schematic partial plan view of the hip set layout of a typical hip roof in which a web connection 50 of the invention may be used. Two opposite sloping roof surfaces intersect at a ridge 40. Adjacent sloping roof surfaces intersect at a hip 70. A supporting girder truss 10 spans the interval between two parallel sides 80 of the roof. A jack truss 30 is attached to the girder truss at a right angle. On each side of the jack truss 30, a corner truss 20 is attached to the girder truss 10 at an angle. A web connector 60 forms the connection 50 between the corner truss 20 and the girder truss 10.

Figure 2A:
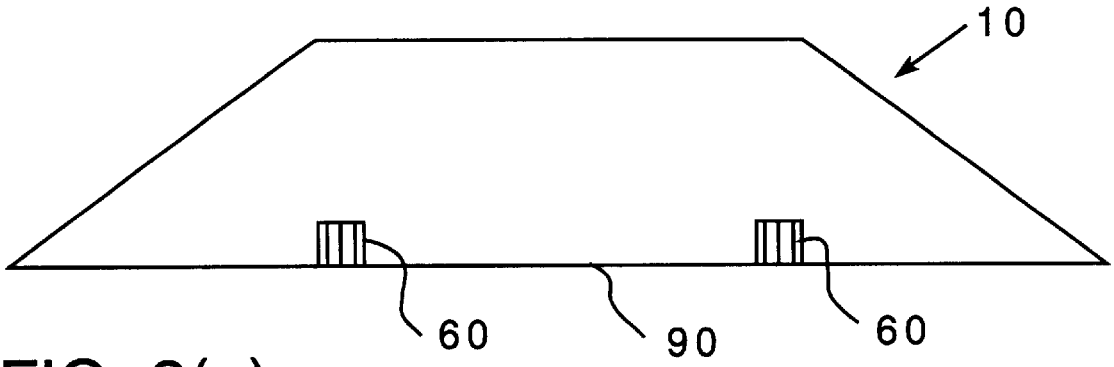
FIG. 2(*a*) is schematic side view showing the profile of a girder truss incorporating an embodiment of the web connector.
Figure 2B:
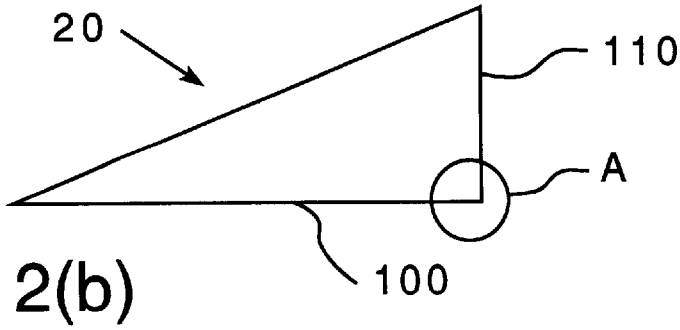

FIG. 2(*a*) is a schematic side view showing the profile of a typical girder truss 10 having a bottom chord member 90. Two web connectors 60 are shown attached to the bottom chord 90, as will be explained in more detail herein.

FIG. 2(*b*) is a schematic view showing the profile of a typical corner truss 20 having a bottom chord 100 and a back vertical member 110. Detail A is shown in FIG. 3.

Figure 3:
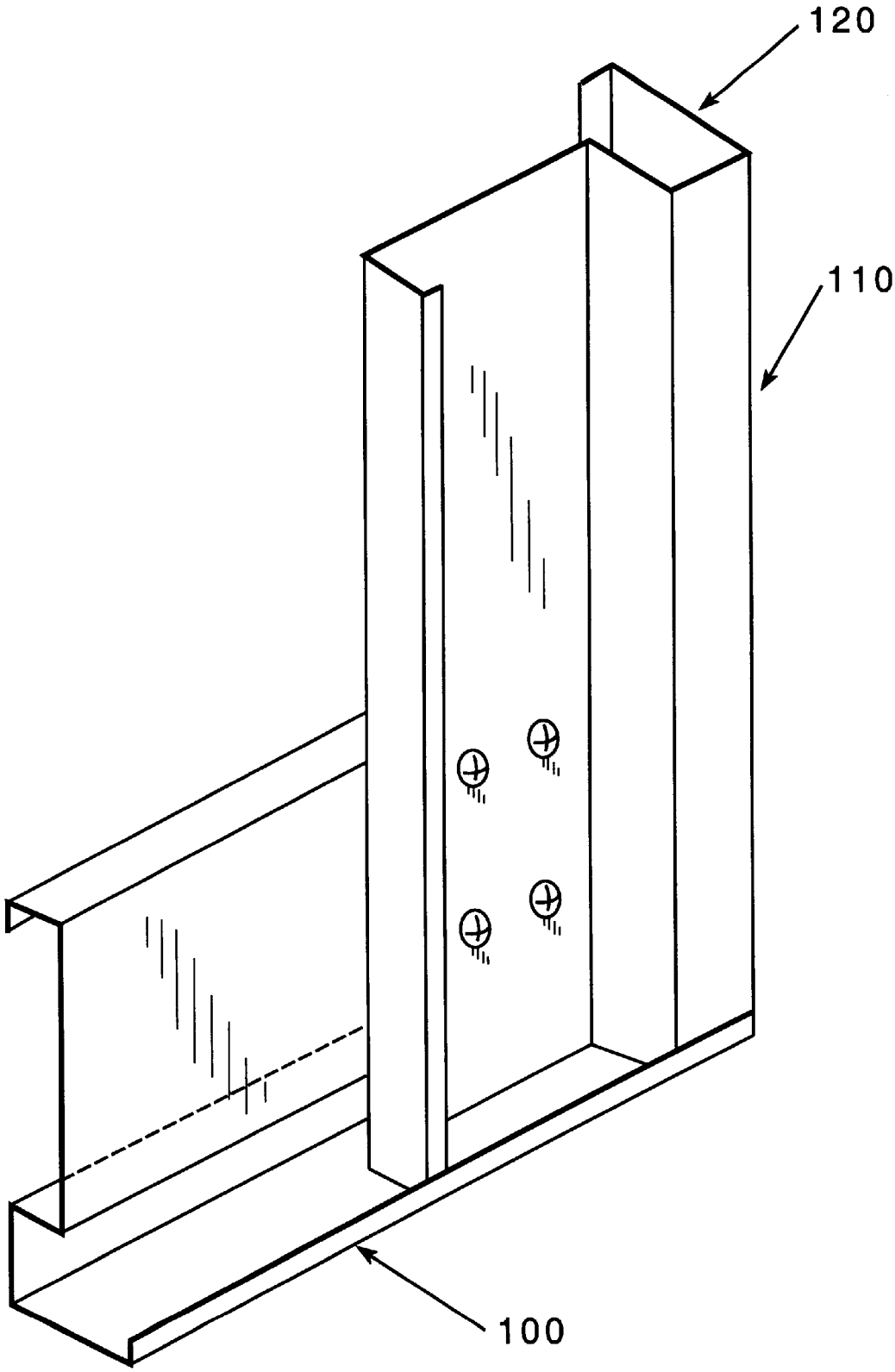
FIG. 3 is an isometric view of detail A of FIG. 2(*b*)

FIG. 3 is an isometric assembly view of detail A of the corner truss 20. A bottom chord member 100 of the corner truss 20 is attached to a vertical member 110 forming a right angle. The vertical member 110 has an attachment flange 120. Preferably, the attachment flange 120 is an elongated, generally planar surface.

Figure 4A:
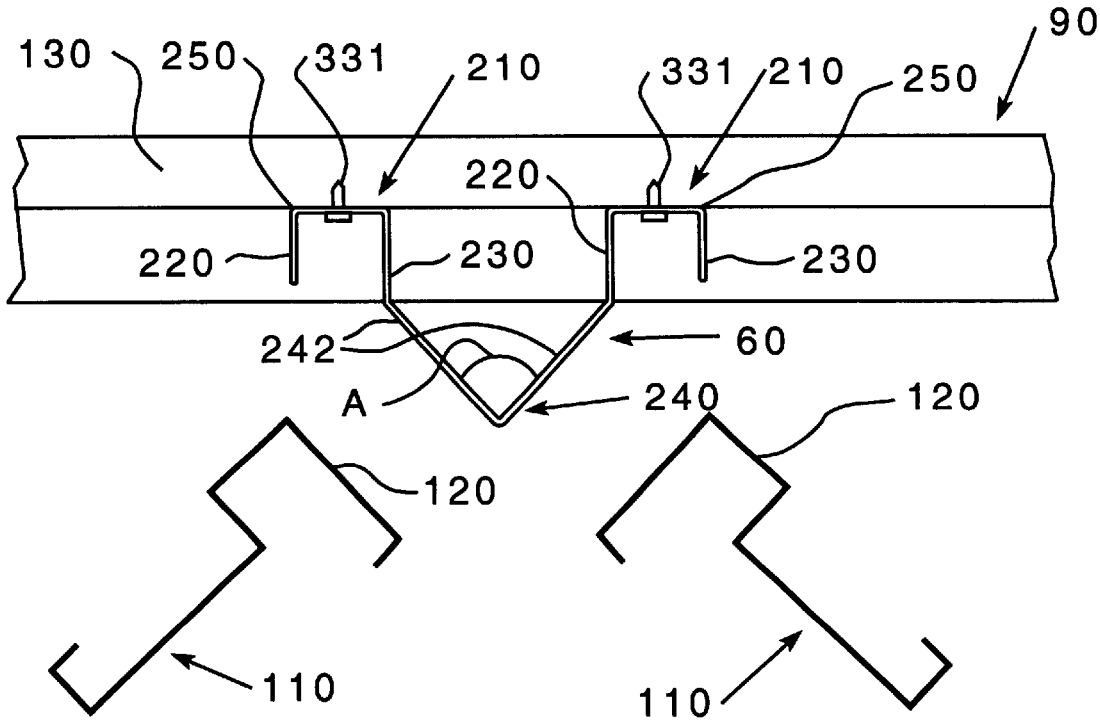
FIG. 4(*a*) is a plan view of an embodiment of the web connector attached to the web of he bottom chord of the supporting truss and ready to be attached to two corner trusses.
Figure 4B:
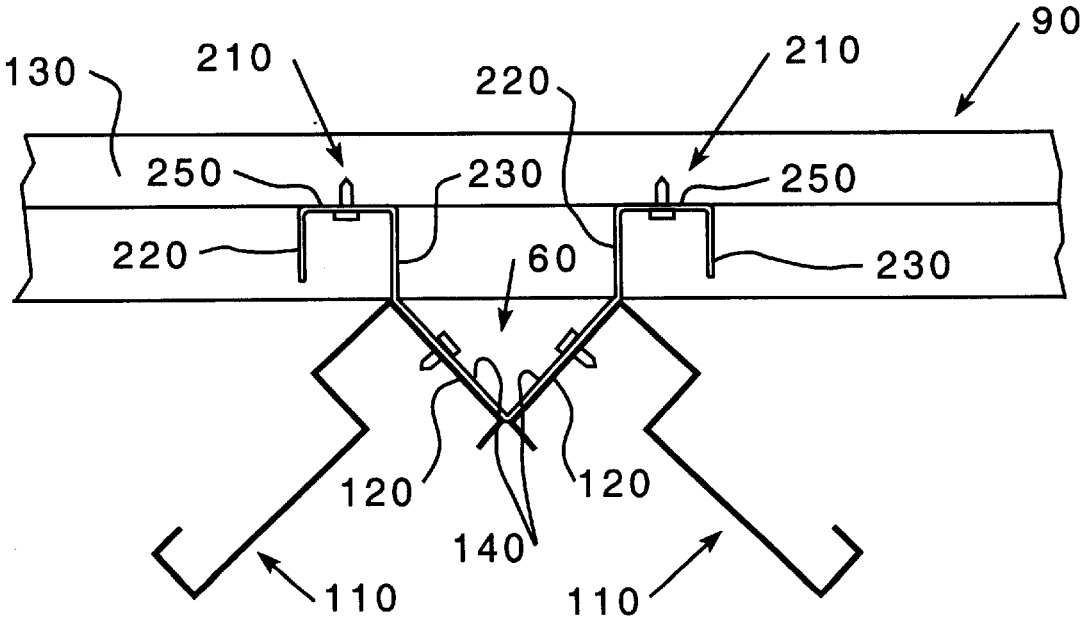

FIG. 4(*a*) is a plan view of an embodiment of the web connector 60, which is shown attached to the web portion 130 of the bottom chord 90 of the supporting truss 10. In this embodiment, the web connector 60 includes two rib members 210 and two attachment plates 242 that form an attachment member 240. Each rib member 210 has a generally open cross-section, such as U-shaped, L-shaped or open trapezoidal section. The rib member 210 has a web attachment element 250, a first flange 220, and a second flange 230 from which the attachment member 240 extends outwardly at an angle. In this embodiment, the web attachment member 240 comprises two attachment plates 242 that are arranged perpendicular to one another (i.e. the angle "A" is 90°). Those of ordinary skill in the art will appreciate, however, that the attachment plates 242 could be arranged at other angles to each other depending upon the particular application. The web attachment element 250 of each rib member 210 is fastened to the web portion 130 of the bottom chord 90 of the girder truss 10. Each, or only one, attachment plate 242 may be attached to the attachment flange 120 of the vertical member 110 of a corner truss 20. In this embodiment, the web connector 60 is integrally formed from one piece of appropriately sized sheet metal, such as steel, utilizing conventional roll forming techniques. For example, the web connector 60 may be fabricated from 20 to 12 gage material meeting the American Society for Testing and Materials code ASTM A653. However, other materials such as composites or plastics may be used.

FIG. 4(*b*) is a plan view of the connection of a supporting girder truss 10 to two corner trusses 20 according to the present invention. The web attachment element 250 of each rib 210 of the web connector 60 is fastened to the web portion 130 of the bottom chord 90 of the girder truss 10 with bolts, screws or similar fastening means 331 through apertures 330. If desired, it is also conceivable that these components could be welded together or glued depending upon the material composition and application. Each attachment plate 120 of the web connector 60 is fastened to the attachment flange 120 of the vertical member 110 of one corner truss 20 by, for example, bolts, screws or other attachments of the types described.

Figure 5A:
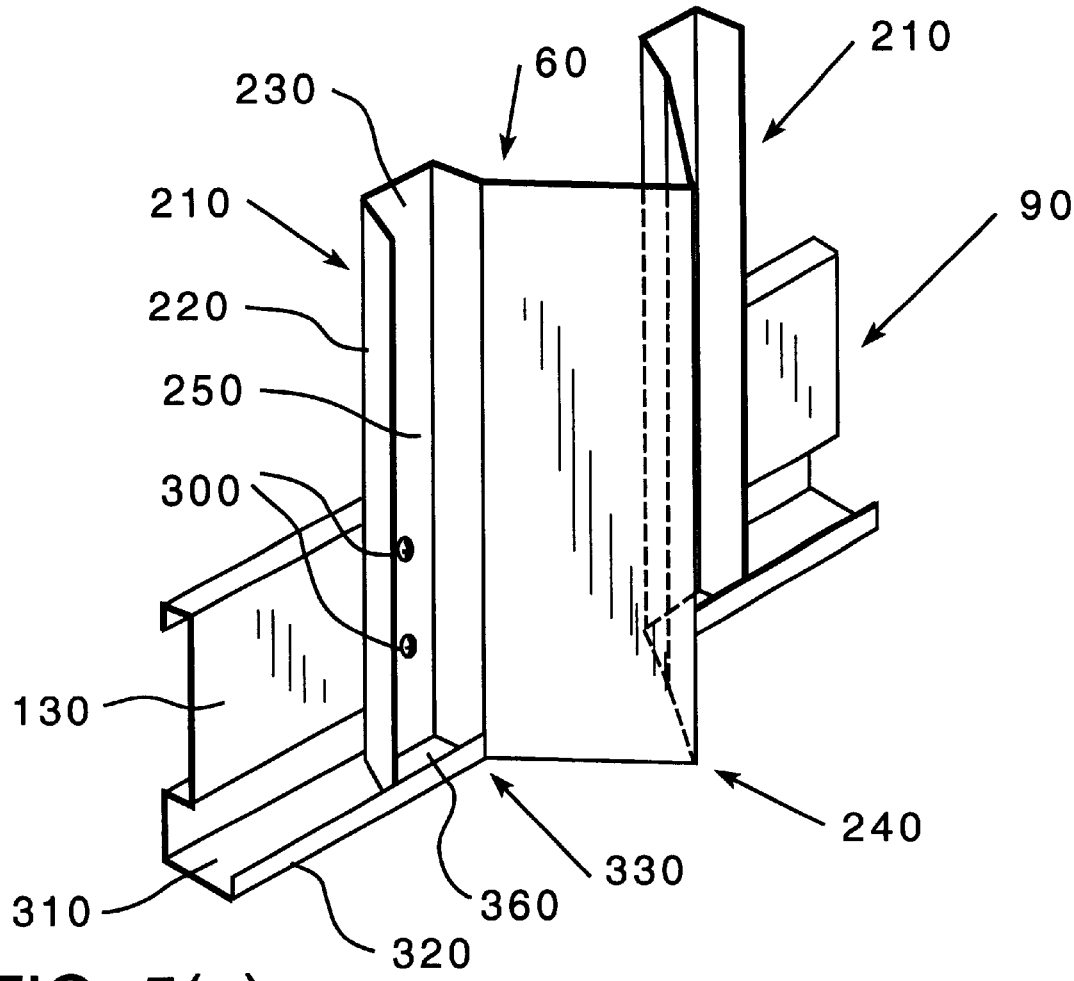
FIG. 5(*a*) is an isometric view of the bottom chord of the girder truss with the web connector attached.
Figure 5B:
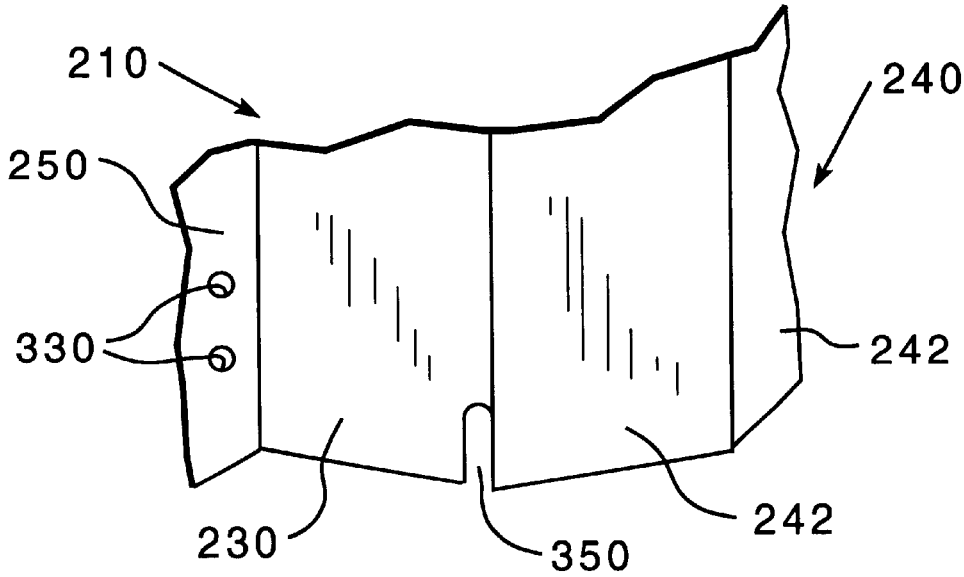

FIG. 5(*a*) is an isometric view of the bottom chord 90 of the girder truss 10 with the web connector 60 attached thereto. The web attachment element 250 of the web connector 60 may include apertures 330 for easy insertion of fasteners 331 therein. Each rib 210 of the web connector 60 has a cross-section sized so that the rib 210 can be supported on the bottom flange 310 of the bottom chord 90 of the girder truss 10 at a first end 360 of the rib 210. A notch 350 in the second flange 230 of each rib member 210 adjacent the attachment plate 242 extending from it, allows the web connector 60 to straddle the upward lip 320 of the bottom chord 90. Insertion of the upward lip 320 into the notch 350, in conjunction with the first end 360 being supported by the flange 310, provides bearing support to the web connector 60 and reduces the number of fasteners 331 needed to attach the web connector 60 to the web portion 130 of the bottom chord 90 of the girder truss 10. This support is more effective when the notch opening has width that is approximately equal to the thickness of the upward lip, approximately 0.1 inches wide.

FIG. 5(*b*) is a partial schematic drawing of the notch 350 at the junction of the second flange 230 of the rib member 210 of the web connector 60 and the attachment plate 242 extending from the rib member 210.

Figure 6:
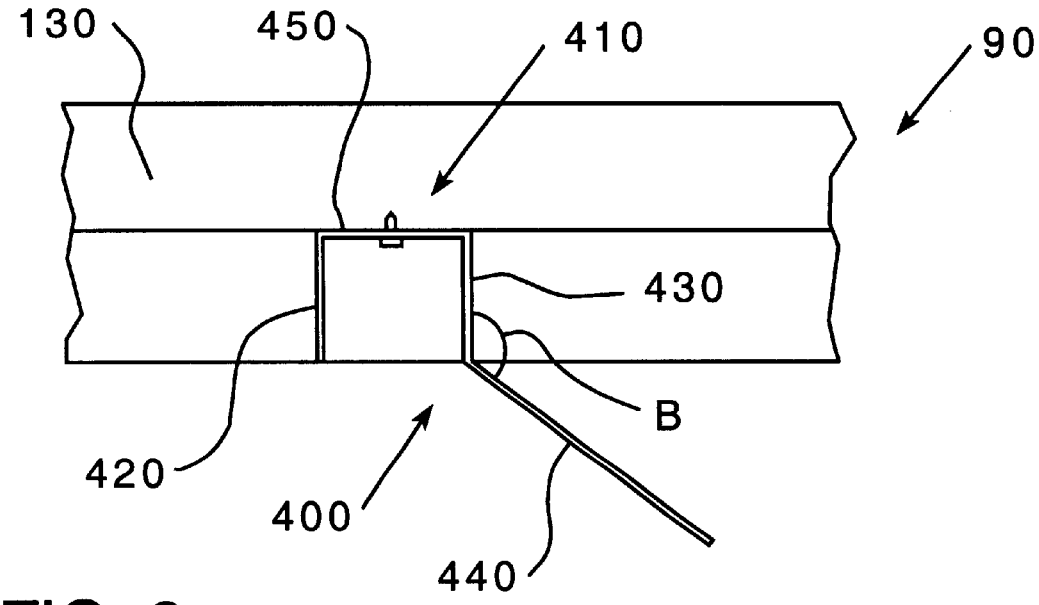
FIG. 6 is a plan view of an alternate embodiment of the web connector.

FIG. 6 is a plan view of an alternate embodiment 400 of the web connector including only one rib member 410 having a web attachment element 450, a first flange 420 and a second flange 430 from which a attachment plate 440 extends. In this embodiment, the attachment plate is arranged at an angle "B" with respect to the flange 430. B may be, for example, 135°; however the attachment plate 440 may be oriented at a variety of other suitable angles relative to the flange 430. This embodiment may be used for connecting one corner truss 20 to a girder truss 10 when symmetry is not particularly important and a smaller and lighter web connector is desirable.

Figure 7:
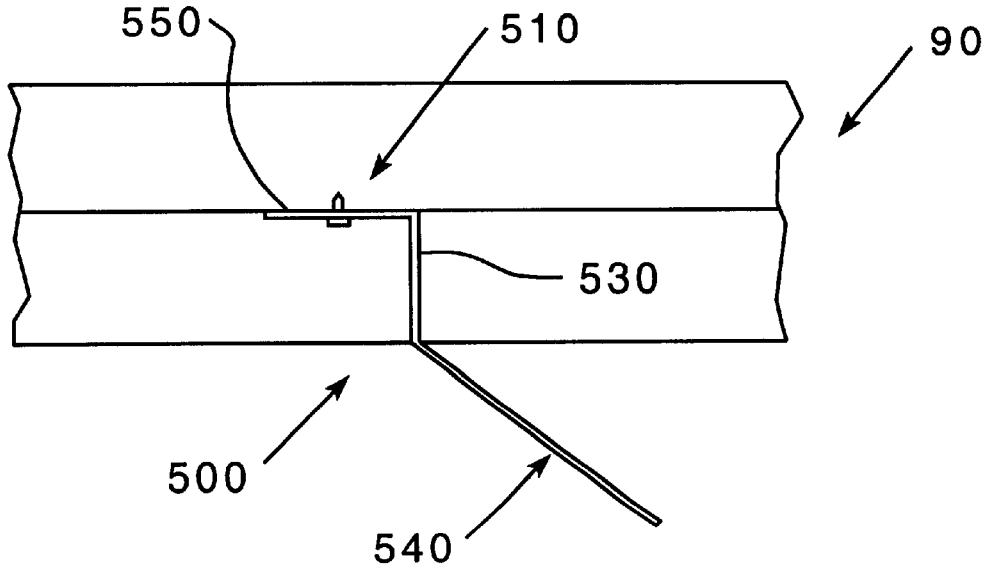
FIG. 7 is a plan view of another embodiment of the web connector.

FIG. 7 is a plan view of another embodiment 500 of the web connector 60. In this embodiment, the rib member 510 includes a web attachment element 550 and a flange 530 extending from the web attachment element 550 to form an L shape.

Figure 8:
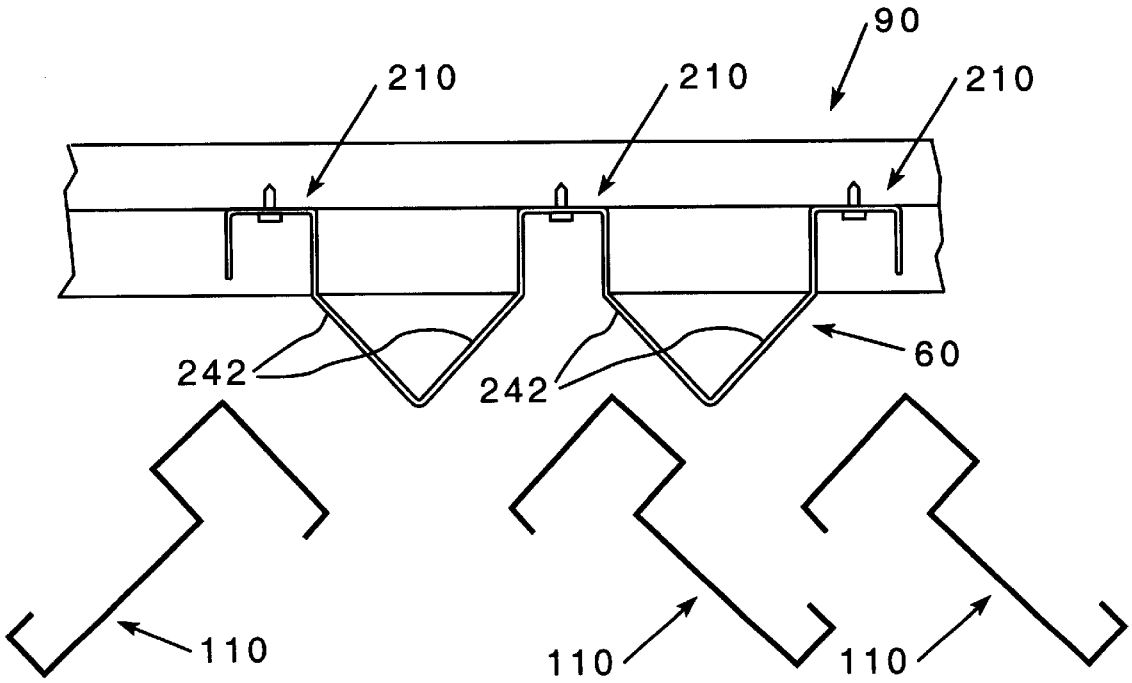
FIG. 8 is a plan view showing an embodiment of the web connector for connecting three corner trusses to a girder truss.

Other embodiments may be easily designed using the embodiments 400 of the web connector. Inclusion of additional rib members 210 without associated attachment plates 242 increases the stiffness and stability of the web connector. The inclusion of additional attachment plates 242 allows the connection of additional supporting trusses 110 at various angles with the girder truss 90, as shown in FIG. 8.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the invention as described in the appended claims.

What is claimed is:

1. A building component connection, comprising:

a first building component having a web portion and a leg portion extending generally outwardly from the web portion;

a second building component having an attachment flange; and a web connector comprising:

a rib member having a web attachment element that is attached to the web portion of the first building component, the rib member having a first end supported on the leg portion of the first building component; and an attachment plate extending outward from the rib member, the attachment plate being connected to the attachment flange of the second building component.

2. The building component connection of claim 1, wherein the rib member has a generally U-shaped cross-section.

3. The building component connection of claim 1, wherein the rib member includes a flange attached to the web attachment element forming an L-shaped cross-section.

4. The building component connection of claim 1, further comprising a notch in the rib member adjacent the attachment plate for receiving a portion of a lip protruding from the leg portion of the first building component.

5. The building component connection of claim 1, wherein the attachment plate of the web connector is at an angle of about 45° relative to the web attachment element of the web connector.

6. The building component connection of claim 1, further comprising a plurality of apertures through the web attachment element of the web connector for receiving a plurality of fasteners to attach the web connector to the web portion of the first building component.

7. The building component connection of claim 1, wherein the first building component is a bottom chord of a girder truss and the second building component is a vertical member of a corner truss.

8. The building component connection of claim 1, wherein the web connector is formed from a material selected from the group consisting of metal and polymer materials.

9. A building component connection, comprising:

a first building component having a web portion and a leg portion extending generally outwardly from the web portion;

a second building component having an attachment flange; and a web connector comprising:

means for supporting the web connector on the leg portion of the first building component;

means for attaching the web connector to the web portion of the first building component; and means for attaching the web connector to the attachment flange of the second building component.

10. A building component connection, comprising:

a first building component having a web portion and a leg portion extending generally outwardly from the web portion;

a second building component having an attachment flange; and a web connector comprising:

a first and a second rib member, each rib member having a web attachment element that is attached to the web portion of the first building component, each rib member having a first end supported on the leg portion of the first building component; and an attachment member connected to the first and second rib members and extending therebetween, the attachment member formed from two attachment plates wherein one of the attachment plates is connected to the attachment flange of the second building component.

11. The building component connection of claim 10, wherein the attachment plates are oriented at an angle of about 45° relative to the corresponding web attachment element of the web connector.

12. The building component connection of claim 10, wherein the attachment plates are oriented at an angle of substantially 90° relative to each other.

13. The building component connection of claim 10, further comprising a notch in a portion of one rib member adjacent the attachment plate for receiving a portion of a lip protruding from the leg portion of the first building component.

14. The building component connection of claim 13, wherein the notch is provided in each rib member adjacent the corresponding attachment plate.

15. The building component connection of claim 10, wherein each rib member has a generally U-shaped cross-section.

16. The building component connection of claim 10, wherein another of the attachment plates is connected to a third building component.

17. A web connector for connecting a first building component and a second building component, the first building component having a web portion and a leg portion that extends generally outwardly from the web portion, and the second building component having an attachment flange, the web connector comprising:

a U-shaped rib member having a web attachment element, the U-shaped rib member sized to be received on the leg portion of the first building component;

an attachment plate extending outward from the rib member, the attachment plate being connected to the attachment flange of the second building component.

18. The web connector of claim 17, wherein an upstanding lip is formed on the leg portion of the first building component and wherein the web connector further comprises a notch in the rib member for receiving a portion of the upstanding lip therein.

19. The web connector of claim 17, wherein the attachment plate of the web connector is at an angle of about 45° relative to the web attachment element of the web connector.

20. The web connector of claim 17, wherein the web connector is formed from a material selected from the group consisting of metal and polymer materials.

21. The web connector of claim 17, wherein the rib member includes a flange attached to the web attachment element forming an L-shaped cross-section.

22. A web connector for connecting a first building component and a second building component, the first building component having a web portion and a leg portion that extends generally outwardly from the web portion, and the second building component having an attachment flange, the web connector comprising:

a first and a second rib member, each rib member having a web attachment element that is attachable to the web portion of the first building component, each rib member having a first end supportable on the leg portion of the first building component and a notched opening through a portion thereof for receiving an upwardly protruding lip of the leg portion of the first building component; and a first and a second attachment plate, each attachment plate extending outward from a corresponding rib member at an angle therebetween and wherein the first attachment plate is connectable to the attachment flange of the second building component.

23. The web connector of claim 22, wherein the attachment plates are interconnected at another angle relative to each other.

24. The web connector of claim 23, wherein the another angle between the first and second attachment plates is about 90 °.

25. The web connector of claim 22, wherein the rib member includes a flange attached to the web attachment element forming an L-shaped cross-section.

26. A web connector, comprising:

first and second rib members;

an attachment member attached to the first and second rib members and extending therebetween; and a notch opening in each of said first and second rib members and extending through a portion thereof adjacent to where the attachment member is attached thereto.

27. The web connector of claim 26, wherein the attachment member forms two attachment plates oriented at an angle relative to each other.

28. The web connector of claim 27, wherein the angle is substantially 90°.

29. The web connector of claim 26, wherein the first and second rib members are U-shaped.

30. The web connector of claim 29, wherein the attachment member forms two attachment plates oriented at an angle relative to each other.

31. The web connector of claim 30, wherein the angle is substantially 90°.

32. A web connector, comprising:

first and second U-shaped rib members;

an attachment member attached to the first and second rib members and extending therebetween, the attachment member forming two plates oriented at substantially 90° to each other; and a notch in each first and second rib member adjacent to the corresponding attachment plate.

33. A method of attaching a first building component to a second building component, the first building component having a web portion and a leg portion extending generally outwardly from the web portion, and the second building component having an attachment flange, the method comprising:

providing a web connector having a rib member and an attachment plate extending outward at an angle from the rib member, the rib member having a web attachment element;

supporting the rib member on the leg portion of the first building component;

fastening the web attachment element of the rib member to the web portion of the first building component; and fastening the attachment flange of the second building component to the attachment plate of the web connector.

34. The method of claim 33, wherein the web connector has a notch formed in the rib member adjacent to the attachment plate, and the step of supporting the rib member further comprises inserting into the notch a lip upwardly protruding from the leg portion of the first building component.

35. A web connector for connecting a first building component and a second building component, the first building component having a web portion and a leg portion that extends outwardly generally from the web portion, and the second building component having an attachment flange, the web connector comprising:

a first rib member having a first web attachment element that is attachable to the web portion of the first building component and a first flange portion attached to the first web attachment element such that the first rib member has an L-shaped cross-section, said first rib member having a first end supportable on the leg portion of the first building component;

a second rib member having a second web attachment element that is attachable to the web portion of the first building component and a second flange portion attached to the second web attachment element such that the second rib member has an L-shaped cross-section, said second rib member having a first end supportable on the leg portion of the first building component; and first and second attachment plates, said first attachment plate extending outward from the flange portion of the first rib member and said second attachment plate extending outward from the flange portion of the second rib member and attached to said first attachment plate and wherein the first attachment plate is connectable to the attachment flange of the second building component.

* * * * *